US005649821A

United States Patent [19]

Fogliani et al.

[11] Patent Number: 5,649,821

[45] Date of Patent: Jul. 22, 1997

[54] GAS BURNER WITH AN IMPROVED DIFFUSER

[76] Inventors: Giuseppe Fogliani, Via Salvo D'Acquisto, 11, Formigine-Modena, Italy, 41043; Enrico Sebastiani, Via S. Banfi, 13, Legnano-Milan, Italy, 20025

[21] Appl. No.: 495,702

[22] Filed: Jun. 27, 1995

[30] Foreign Application Priority Data

Jul. 8, 1994 [IT] Italy ..... MI94A1431

[51] Int. Cl.[6] ..... F23D 3/40

[52] U.S. Cl. ..... 431/326; 431/354; 239/568; 239/556; 239/557

[58] Field of Search ..... 431/326, 329, 431/354; 239/568, 556, 557

[56] References Cited

U.S. PATENT DOCUMENTS 3,285,317 11/1966 Hein et al. ..... 239/568
3,361,367 1/1968 Hein et al. ..... 239/568
4,951,880 8/1990 Riehl ..... 239/568
5,215,457 6/1993 Sebastiani ..... 431/326
5,344,312 9/1994 Polidero ..... 431/326

*Primary Examiner*—Carroll B. Dority

[57] ABSTRACT

A gas burner of the type in which a inflammable mixture is caused to flow out of a diffuser, is formed of a plurality of parallel slots separated by grid elements, and distributed into a pair of grids separated by an elongate screen extending between the two grids. The burner includes at least one elongate slot extending perpendicular to said screen along the width of said grid pair, perpendicular to the screen, near the grids, and adapted to take up relative dimensional variations of said screen and the grid elements brought about by differential heatings of the screen and the burner walls surrounding the diffuser.

19 Claims, 3 Drawing Sheets

GAS BURNER WITH AN IMPROVED DIFFUSER

DESCRIPTION

BACKGROUND OF THE INVENTION

The present invention relates to gas burners, in particular to diffusers for such burner in which the combustion of the gaseous mixture takes place.

Gas burners consist basically of a nozzle through which a fuel gas, such as methane, propane, and the like, under a pressure is injected into a mixing tube, usually a venturi type of tube, where a suitable flow of combustion air or primary air is drawn in, due to the suction generated by the flowing fuel gas.

The primary air, once admixed to the gas in a appropriate proportion therewith, forms a flammable mixture which is directed into a mixing and distribution chamber formed of a box-type body of sheet metal provided with openings called diffusers.

The mixture flows out of the diffusers, of suitable size, at a suitable velocity which varies with flow rate, and is ignited outside the diffusers, either by a pilot flame or suitable igniting devices.

The shape and size of the diffusers is particularly critical to an efficient combustion and to the flame stability under different conditions of operation, as well as for preventing backfiring.

The applicant has developed for this purpose burners with high specific power and low NOx and CO emissions which employ diffusers with pairs of side-by-side grids separated transversely by a screen, from which the inflammable mixture is caused to flow out at a relatively high velocity. The high velocity is a multiple of the flame rate of propagation at full power, when the air-to-gas ratio of the mixture is approximately stoichiometric or higher (0.8<lambda<1.6).

Diffusers of this type, being the subject matter of a patent EP-A 0373157 to the applicant, allow laminar flames or particularly stable flame fronts to be generated which extend across divergent surfaces having their origin located close to the central screen, and spreading out in a variable manner according to the outflow velocity, inversely therewith.

Since the flame develops across two surfaces which are spaced apart from the element or plate whereon the diffusers are formed, the material from which the diffusers are formed is stressed thermally to a negligible extent, is unaffected by ageing due to fatigue and is not subjected to wear or alteration of its structural characteristics.

Thus, the useful life of a burner equipped with this type of diffuser (additionally to its efficiency and specific power) is much longer than the life of conventional burners wherein the flame generated by a flow of a mixture of air and fuel at a velocity slightly higher than the flame propagation rate develops in close proximity to the diffuser with local burner overheating.

Diffusers of this type can operate at variable flow rates, and therefore, under modulated conditions.

However, at reduced flow rates and consequently reduced velocity of the fuel mixture outflow (or with gas used at a higher flame propagation rate than anticipated), the flame tends to approach the diffuser walls causing localized heating of the grid pair and the screen interposed therebetween (similar to that of conventional burners).

In these conditions, the differentiated burner heating, with the temperature surge that may attain 300°–350° C., causes local internal expansions and stresses which fatigue the material and result ultimate failure of the same.

SUMMARY OF THE INVENTION

According to the present invention, this drawback is obviated by providing a gas burner with a dual grid diffuser wherein at least one slit or slot is associated with the dual grid and adapted to permit recovery of differential elongations of the screen interposed between the grids (as well as of the grid elements) relative to the other parts of the burner, with the screen being the element which is more likely to undergo localized heating when operating with the flame close to the walls.

According to a further aspect of the present invention, the slit or slot associated with the dual grid is provided with a projection jutting into the slot to prevent deformations of the grid during the burner profile shaping operations.

BRIEF DESCRIPTION OF THE DRAWINGS

The features and advantages of the invention will be more clearly apparent from the following description of a preferred embodiment of the invention and from the accompanying drawings, in which.

DESCRIPTION OF THE PREFERRED EMBODIMENTS

Figure 1:
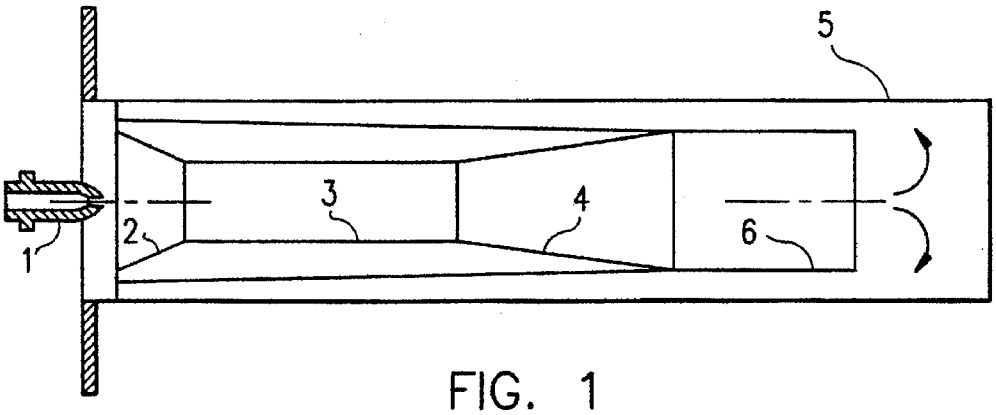
FIG. 1 is a sectional view of an exemplary structure of a gas burner.
Figure 2:
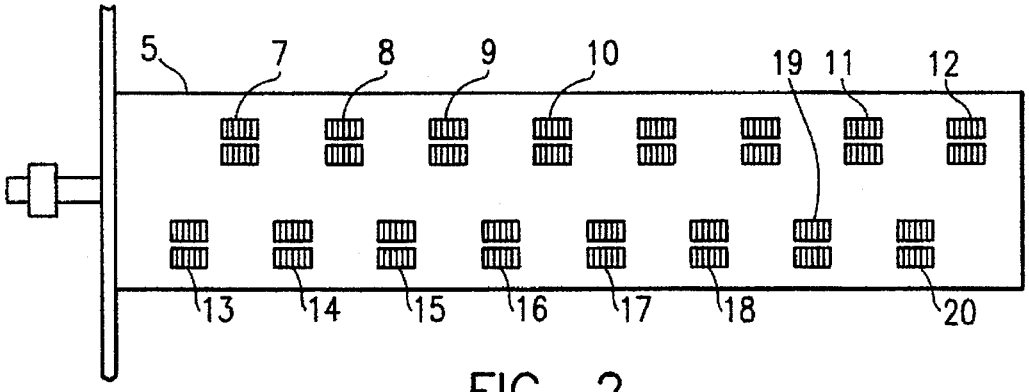
FIG. 2 is a top view of the burner in FIG. 1.

Referring to FIGS. 1 and 2, a gas burner basically comprises a nozzle 1 which injects a stream of fuel gas (methane, butane, and the like) into a venturi tube formed of a convergent frustum of cone 2, a cylindrical segment 3 of smaller cross-section, and a divergent frustum of cone 4, all enclosed within a box-type burner body 5, for example, but not necessarily, of cylindrical shape.

The convergent frustum of cone 2 is in communication with the atmosphere and the divergent frustum of cone 4 is open to the box-type body 5 interior through an outlet 6.

The box-type body 5, in turn (FIG. 2), communicates to the outside through openings or diffusers 7, 8 . . . 20.

Suction developed by the stream of fuel gas in the throat of the venturi causes combustion air to be drawn in through the convergent frustum of cone.

By suitably sizing and positioning the venturi tube relative to the nozzle 1, an intake of air correctly proportioned to the gas can be developed.

Turbulence induced within the frustum of cone 4 and the outlet 6 results in the gas being blended with the air taken in, and in a combustible mixture being formed which flows out through the diffusers 7 . . . 20 at a variable flow velocity with the cumulative input flow rate, and in general, higher than the flame propagation rate.

Figure 3:
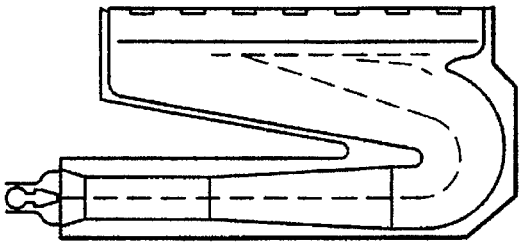
FIG. 3 is a side view of a further example of a gas burner.

Quite similar is the operation of the burner of FIG. 3, known as a "pipette" or "small ramp" type burner, wherein the venturi tube, instead of being extended into a mixing distribution chamber of cylindrical shape which surrounds the venturi, is extended into a chamber located on top (or laterally) of the venturi tube and connected thereto by an elbow.

On igniting the mixture outside the burner by an appropriate means, each diffuser becomes a source of a flame whose shape is a function of the diffuser shape.

Figure 4:
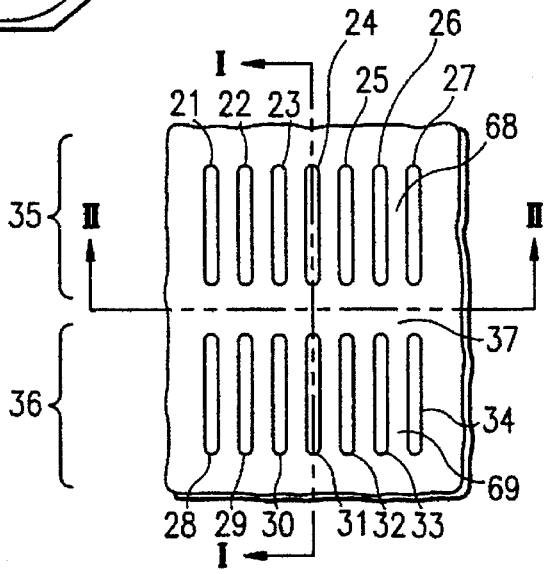
FIG. 4 is an enlarged view of a diffuser of the burners of FIGS. 1, 2 and 3.

FIG. 4 is an enlarged view of a preferred embodiment of one of the diffusers 7 . . . 20.

Each diffuser comprises a plurality of elongate openings or rectilinear slots 21 . . . 34 provided in the box-type body and arranged parallel to one another in two rows to form a pair of grids 35, 36 which are separated by an elongate portion 37 of the wall of the box-type body which, on account of the function it serves, can be termed a screen.

The slots 21 . . . 34 shown in FIG. 4 have a suitable width in the same order of magnitude as the thickness of the wall of the box-type body, for example, of 0.5–0.7 mm, and are separated from each other by a grid element of a similar width. In FIG. 4, the grid elements are referenced by numerals 68 and 69.

The length of the slots is of a greater order of magnitude than the width, for example, of 7 mm.

The screen 37 which separates the two grids 35, 36 suitably has a width on the order of 1.5–4 times the width of the slots 21 . . . 34.

This type of diffuser is, as shown in FIG. 4, unique in that its develops a flame which extends into two divergent fronts arranged like the wings of a butterfly.

Figure 5:
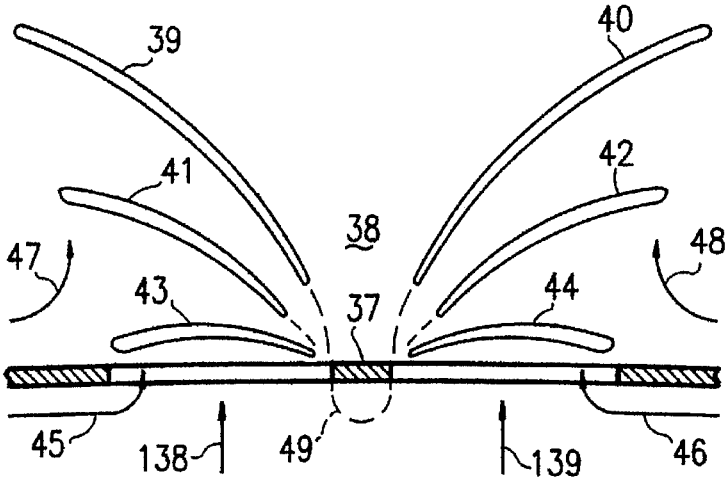
FIG. 5 shows a diffuser according to section I—I of FIG. 4, and the flame produced thereby at different flow rates.

The combustible mixture flows out through the slots 21 . . . 34 of the respective diffuser along the direction of arrows 138, 139 in FIG. 5.

Upon the mixture being ignited, the area 38 overlying the screen 37 becomes saturated with burned gases which are fed continuously by the combustion, while at the diffuser periphery, cool air is drawn in which feeds the mixture and depletes it, thereby reducing the flame propagation rate.

Thus, two opposed flame fronts 39, 40 develop which are very stable and whose spatial position depends on the combustible mixture outflow velocity and, hence, on its flow rate.

It should be noted that the same type of flame is also generated by burners wherein the two grids are separated by a screen extending in the same direction as the grid elements, as described in the aforementioned patent i.e., EP-A 0373157.

If the flow rate decreases (or if the flame rate of propagation increases), the flame fronts, at maximum flow rate spaced well away from the burner, tend to move down and approach the burner, taking the positions indicated by the references 41, 42, and in the extreme, 43, 44.

It can be seen, therefore, that the type of flame developed tends, by thermal radiation of the flame and conduction, to heat the screen 37 more than the walls of the burner which surround the diffuser.

These are, in fact, swept inside the burner by a stream of low-temperature mixture, represented by arrows 45, 46, which cools it and outside by a stream of cool air represented by arrows 47, 48 induced by the outflow of combustible mixture.

On the contrary, within the box-type burner body close to the screen 37, a stagnation zone 49 of the combustible mixture is present which isolate the screen thermally.

The same stagnant situation occurs outside the box-type body close to the screen 37.

As a result, in operation of the burner, the screen 37 is heated to a higher temperature than the burner walls which surround the diffuser, and the grid elements interposed between the slots 21 . . . 34 are at an intermediate temperature.

The difference in temperature is a modest one at large flow rates, but tends to increase up to values on the order of 300° C. as the gas flow rate decreases (or as the flame propagation rate increases).

The net result is a differential expansion of the screen 37 and the grid elements, which is greater the smaller the flow rate (or the greater the flame rate of propagation).

Figure 6:
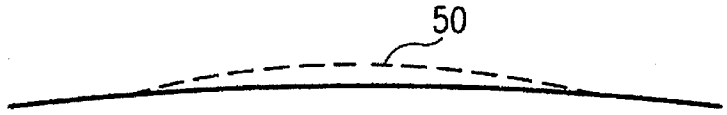
FIG. 6 shows schematically, along to section I—I of FIG. 4, the deformations induced in the diffuser by differential thermal expansions.
Figure 7:
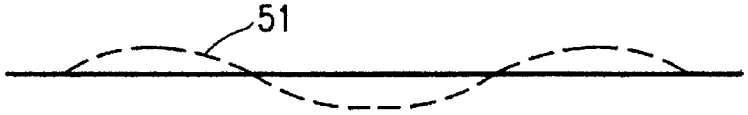
FIG. 7 shows schematically, along to section II—II of FIG. 4, the deformations induced in the diffuser screen by differential thermal expansions.

FIGS. 6 and 7 illustrate qualitatively the deformations caused by the differential expansions in the grid elements (FIG. 6) and the screen 37 (FIG. 7).

Since the surface of the box-type burner body 5 is generally convex outwardly and the slots 21 . . . 34 are arranged to lie in the direction of curvature of the body, the elongation of the grid elements relative to the box-type burner body 5 can be easily accommodated by a greater curvature represented by the dash line 50, at internal elastic stresses of minimal magnitude. However, it should not be overlooked that the grid elements, being attached with one end to the screen 37, do respond to the screen deformations.

Quite different is the situation in which the screen 37, which is subjected to much greater expansion, will find itself.

The screen 37, with the ends attached to the walls of the burner body 5 and intermediate points attached to the pairs of grid elements, undergoes much greater deformation, with considerable internal stresses and flexures and a development, unforeseeable to some extent, of multiple waves as indicated by dash line 51.

Due to the flow rate modulation and repeated on/off cycling of the burner, it is fatigue stressed especially at the ends and susceptible to long term failure.

The screen 37 deformation also involves the grid elements, one end of each grid element which is attached to the screen 37, with consequent long term failure of these parts as well.

Figure 8:
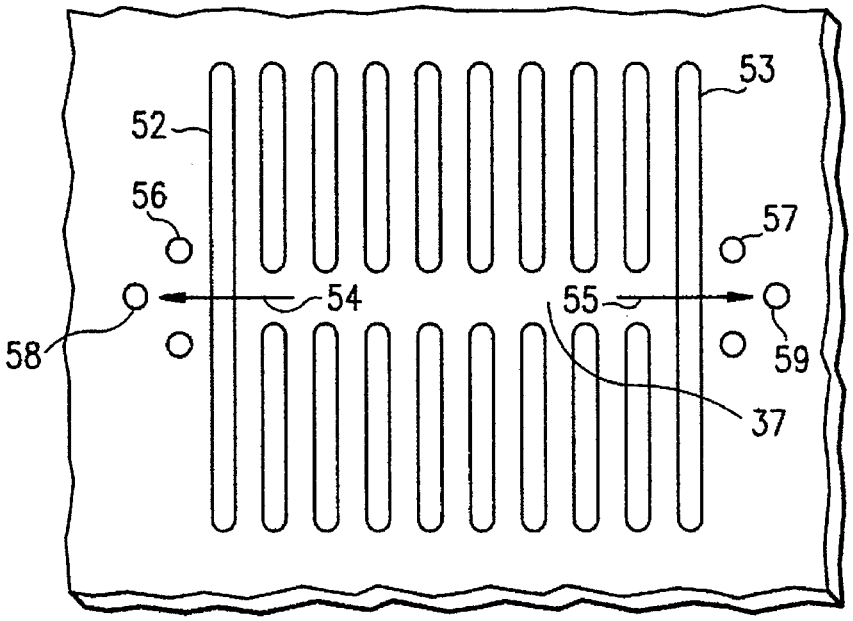
FIG. 8 is a top view of a preferred embodiment of the grid diffuser embodying the present invention.

This drawback is obviated and the useful life of the burner further extended by providing, as shown in FIG. 8, diffusers wherein the grid element pairs are flanked by an additional pair of slits or slots 52, 53 having, preferably but not necessarily, the same width as the diffuser slots 21 . . . 34 and a length substantially equal to the width of the diffuser in the perpendicular direction to the screen direction, and are located at the ends thereof.

In this way, the expansions of the screen 37 in its length direction, indicated by arrows 54, 55, can occur without flexure and corresponding fatigue stressing.

By having the screen 37 not connected to the walls of the diffuser, the added advantage is secured of releasing one end of the grid elements from the diffuser walls, imposed with the intermediary of the screen.

The resultant structure has side-by-side beams twice as long as the grid elements (with the screen width added).

This allows the grid elements to accommodate elongations relative to the diffuser walls with induced bending moments of much reduced magnitude and minimized consequent fatigue effects.

While two additional slots 52, 53 are preferable, to also minimize the fatigue stresses of the grid elements, it is apparent theft in relation to the length of the screen 37 (and grid elements) a single additional slot located at one side or at the center, if necessary, of the grid pairs of the diffuser may suffice.

The additional slots contribute toward developing end flame fronts which open fan-like to form, with the flame fronts generated by the other slots, a stable flame which opens wineglass-like and encloses a relatively static burned gas volume to ensure the flame stability.

As a further improvement, one or more circular or elongate openings 56, 57, 58, 59 may advantageously be provided opposite the screen 37 with respect to the additional slots 52, 53.

These openings function to develop small flames which improve the stability of the flame fronts generated by the diffuser slots 21 . . . 34.

In the instance of the tubular burner body being profiled by a set of rollers, there occur, in the course of the production process, stresses having a transverse component to the direction of slot development which can deform the diffuser elements.

According to a further aspect of the present invention, to avoid this problem, the additional slots of increased length are provided with projections jutting into their interiors which locally reduce the slot width to the minimum required to allow the screen to expand.

In fact, it is apparent that with the slots being generally formed by punching, their width cannot be less than a certain limiting value related to the thickness of the material to be punched. As previously mentioned, this width is illustratively of 0.5–0.7 mm, while the relative elongation of the screen at maximum working temperature may be much less.

Figure 9:
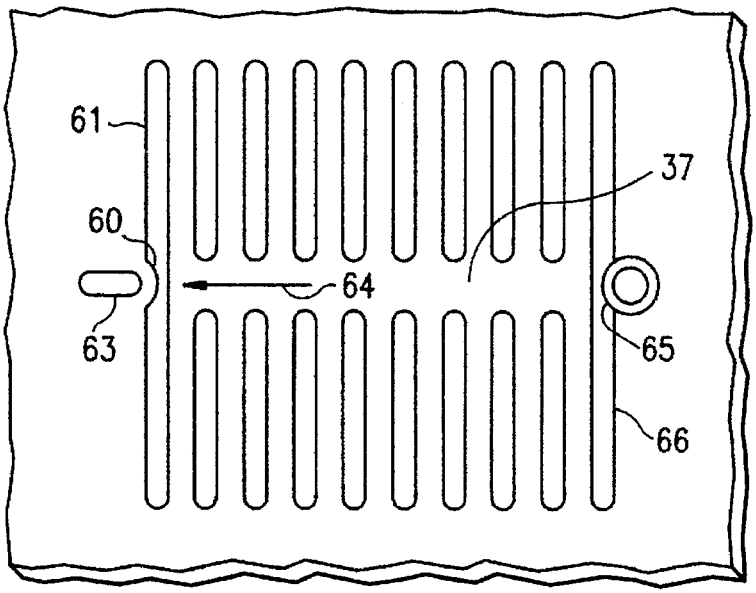
FIG. 9 shows two variations of the diffuser in FIG. 8.

As shown in FIG. 9, these projections are preferably obtained by two different types of processing.

The projection 60 in the slot 61 is obtained, for example, by making in the wall 62 of the burner, in close proximity of the slot 61, and at the screen 37, an opening 63 in the form of a slot or a circular opening.

The opening 63 is obtained by punching, subsequent to the punching which results in the slot 61, so that the plasticity of the material develops a bulge or projection 60 into the slot 61.

Thus, if the screen is stressed, in the course of a subsequent profiling operation, in the direction of arrow 64, it bears on the projection 60, and further deformations at the limit of plastic yield are prevented.

It is apparent that in the instance of plastic yield, the expansion clearance lost at one end of the screen 37 is recovered at the other end.

Alternatively, a projection 65 can be obtained by punching without perforation, which squeezes the material plastically driving it into an already formed slot 66.

This plastic deformation can be both obtained in the burner wall which surround the diffuser 5 and in the screen 37, or both.

The foregoing description only covers a preferred embodiment and some variations thereof, but it is apparent that many variations may be introduced.

Figure 10:
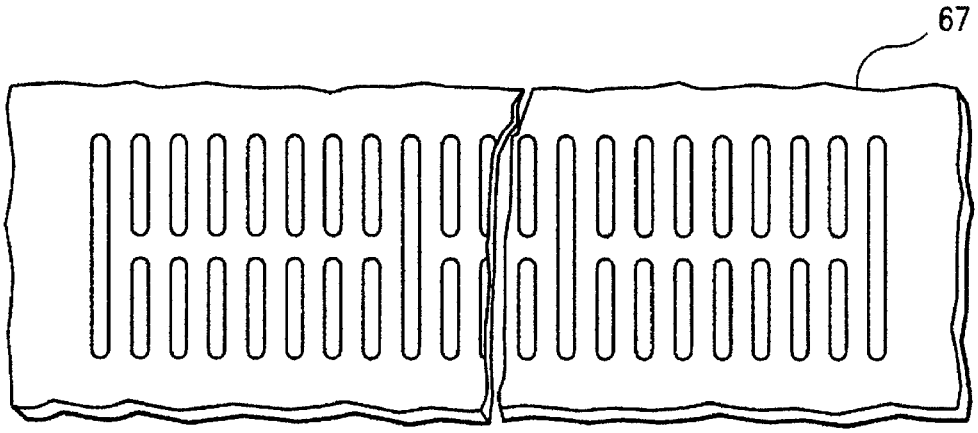
FIG. 10 shows a third variation of the diffuser in FIG. 8.

For example, as shown in FIG. 10, a burner 67 may be provided, instead of with a plurality of diffusers 7 . . . 20, with a continuous dual grid diffuser which extends over the whole length of the burner.

In this case, the screen intermediate the grids may be divided into a plurality of sections by means of a plurality of elongate slots disposed across the screen a predetermined distance from one another as shown in FIG. 10.

Figure 11:
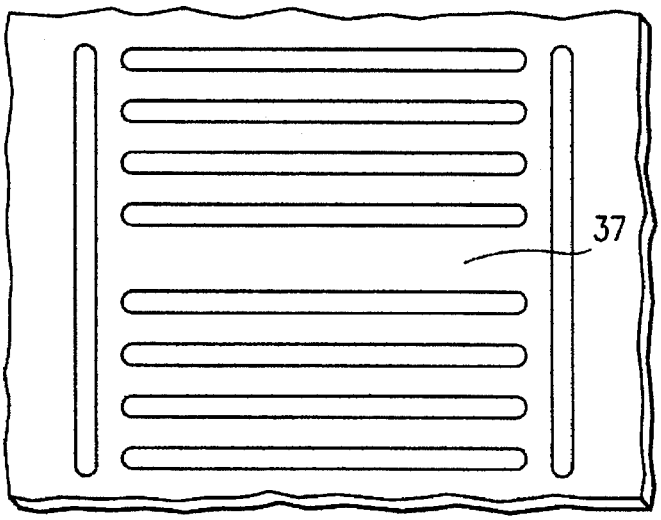
FIG. 11 shows a fourth variation of the diffuser according to the invention.

As a further example, shown in FIG. 11, the invention can be applied to diffusers wherein the grid slots are disposed parallel to the direction of screen extension 37.

In this case, the additional slots, preferably at least two in number, are disposed perpendicularly to the direction of extension of the screen 37 and the grid slots.

What we claim is:

1. A gas burner of the type in which a flammable mixture is caused to flow out of at least one diffuser formed of a plurality of parallel slots distributed into a pair of grids separated by an elongate screen having two ends, and extending between the two grids, wherein said diffuser comprises:

at least a first elongate slot extending perpendicular to said screen and extending substantially the width of said diffuser; and adapted to take up relative dimensional variations of said screen brought about by differential heatings of said screen and burner walls surrounding said diffuser.

2. The burner of claim 1, wherein said screen is elongated perpendicular to said grid slots, and said at least a first elongate slot extends parallel to said grid slots at least at one end of said screen.

3. The burner of claim 1, wherein said screen is elongated parallel to said grid slots, and said at least a first elongate slot extends perpendicular to at least at one end of said screen and to said grid slots.

4. The burner of claim 1 comprising at least a second elongate slot extending perpendicular to said screen and located at the other end of said screen.

5. The burner of claim 2, comprising at least a second elongate slot extending perpendicular to said screen at the other end of said screen.

6. The burner of claim 5, comprising at least a third elongate slot parallel to and intermediate said at least a first elongate slot and said at least a second elongate slot, said at least a third elongate slot dividing said elongate screen into a least two screen segments.

7. The burner of claim 5, wherein said at least a first elongate slot and said at least a second elongate slot have the same width as said grid slots, and are spaced equidistant therefrom.

8. The burner of claim 4 comprising a projection jutting into at least one of said at least a first elongate slot and said at least a second elongate slot of said diffuser.

9. The burner of claim 8, farther comprising an opening formed by punching in the wall around said diffuser near at least one of said at least a first elongate slot and said at least a second elongate slot, said punching causing said projection to be formed.

10. The burner of claim 8, further comprising a dimple formed by punching in the wall near at least one of said at least a first elongate slot and said at least a Second elongate slot, said punching resulting in said projection being formed.

11. The burner of claim 1 comprising at least one opening formed in the wall around said diffuser opposite said screen with respect to said first elongate slot to enhance, as a result of the outflow of flammable mixture through said opening, the flame stability when said burner is in use.

12. The burner of claim 3 comprising at least a second elongate slot extending perpendicular to said screen and located at the other end of said screen.

13. The burner of claim 5 comprising a projection jutting into at least one of said at least a first elongate slot and said at least a second elongate slot of said diffuser.

14. The burner of claim 12 comprising a projection jutting into at least one of said at least a first elongate slot and said at least a second elongate slot of said diffuser.

15. The burner of claim 13 further comprising an opening formed by punching in the wall around said diffuser near at least one of said at least a first elongate slot and said at least a second elongate slot, said punching causing said projection to be formed.

16. The burner of claim 14 further comprising an opening formed by punching in the wall around said diffuser near at least one of said at least a first elongate slot and said at least a second elongate slot, said punching causing said projection to be formed.

17. The burner of claim 13, further comprising a dimple formed by punching in the wall near at least one of said at least a first elongate slot and said at least a second elongate slot, said punching resulting in said projection being formed.

18. The burner of claim 14, further comprising a dimple formed by punching in the wall near at least one of said at least a first elongate slot and said at least a second elongate slot, said punching resulting in said projection being formed.

19. The burner of claim 1, wherein said screen is elongated perpendicular to said grid slots, and said at least a first elongated slot extends parallel to said grid slots at a position intermediate to said screen, and dividing said elongate screen into two screen segments.

* * * * *